United States Patent [19]

Asano

[11] 4,099,349

[45] Jul. 11, 1978

[54] CAM GRINDING MACHINE WITH SWING TABLE SUPPORT DEVICE

[75] Inventor: Hiroaki Asano, Chiryu, Japan

[73] Assignee: Toyoda Koki Kabushiki-Kaisha, Japan

[21] Appl. No.: 844,199

[22] Filed: Oct. 21, 1977

[30] Foreign Application Priority Data

Nov. 4, 1976 [JP] Japan ..... 51-147232[U]

[51] Int. Cl.[2] ..... B24B 5/42

[52] U.S. Cl. ..... 51/101 R; 51/237 CS

[58] Field of Search ..... 51/94 R, 97 NC, 101 R, 51/234, 237 R, 237 CS, 166 R; 82/9, 40 A

[56] References Cited

U.S. PATENT DOCUMENTS

| | | | |
|---|---|---|---|
| 2,641,874 | 6/1953 | Kirby | 51/101 R |
| 2,732,668 | 1/1956 | Olsson | 51/101 R |
| 3,468,070 | 9/1969 | Fries | 51/101 R |

FOREIGN PATENT DOCUMENTS 469,994 4/1971 Japan.

*Primary Examiner*—N. P. Godici

*Attorney, Agent, or Firm*—Oblon, Fisher, Spivak, McClelland & Maier

[57] ABSTRACT

In a cam grinding machine, first and second support means are mounted on a first surface of a traverse table for swingably supporting a swing table at opposite ends thereof. A third support means is arranged between the first and second support means and mounted on a second surface of the traverse table. The second surface is lower than the first surface. A shaft is rotatably supported by the third support means and a tightening means is provided for fixing the opposite ends of the shaft into bores formed on inside walls of the swing table.

4 Claims, 3 Drawing Figures

CAM GRINDING MACHINE WITH SWING TABLE SUPPORT DEVICE

BACKGROUND OF THE INVENTION

1. Field of the Invention

The present invention relates to a cam grinding machine for grinding a cam shaft and, more particularly, to a swing table support device in the cam grinding machine.

2. Description of the Prior Art

Recently, in order to improve grinding efficiency of cam grinding machines, the grinding wheel is rotated at a higher speed or a grinding wheel made of cubic boron nitride (CBN) is used which can be fed toward a workpiece to be ground at a higher feed rate. A conventional swing table and a support thereof in a cam grinding machine for a cam shaft cannot meet these requirements due to a lack of rigidity. In the conventional cam grinding machine, the swing table is swingably supported on the traverse table at its opposite ends and at the middle portion thereof. The intermediate support is mounted on the traverse table at the same surface as that mounting the opposite supports and therefore the flange portion thereof projects beyond the upper mounting surface of the traverse table. Accordingly, in order to prevent interference of the swing table with the flange portion of the intermediate support at its swing ends, a considerable portion of the lower side walls of the swing table has to be eliminated or cut away. This results in lowering the rigidity of the swing table.

Furthermore, in order to swingably support the swing table by the intermediate support, a shaft is fixed in the intermediate support and the opposite ends of the shaft are inserted through bearings in a pair of inside walls depending from the underside of the swing table. A cantilever boring tool has to be moved from one side of the swing table in order to make bores on the inside walls for bearing support, which results in dispersion of the finished bores. This is another factor of lack of rigidity of the swing table.

SUMMARY OF THE INVENTION

It is an object of the present invention to provide a new and improved cam grinding machine, wherein a swing table is swingably supported on a traverse table with high rigidity.

Another object of the present invention is to provide a new and improved cam grinding machine, wherein a swing table is swingably supported by first and second support means mounted on a first surface of a traverse table and by a third support means arranged between the first and second support means and mounted on a second surface of the traverse table which is lower than the first surface.

Briefly, according to the present invention, these and other objects are achieved by providing a cam grinding machine which comprises a traverse table, a swing table, first and second support means mounted on a first surface of the traverse table for swingably supporting the swing table at opposite ends thereof, third support means arranged between the first and second support means and mounted on a second surface of the traverse table, the second surface being lower than the first surface, a shaft rotatably supported by the third support means, and tightening means for fixing the opposite ends of the shaft into bores formed on inside walls of the swing table.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
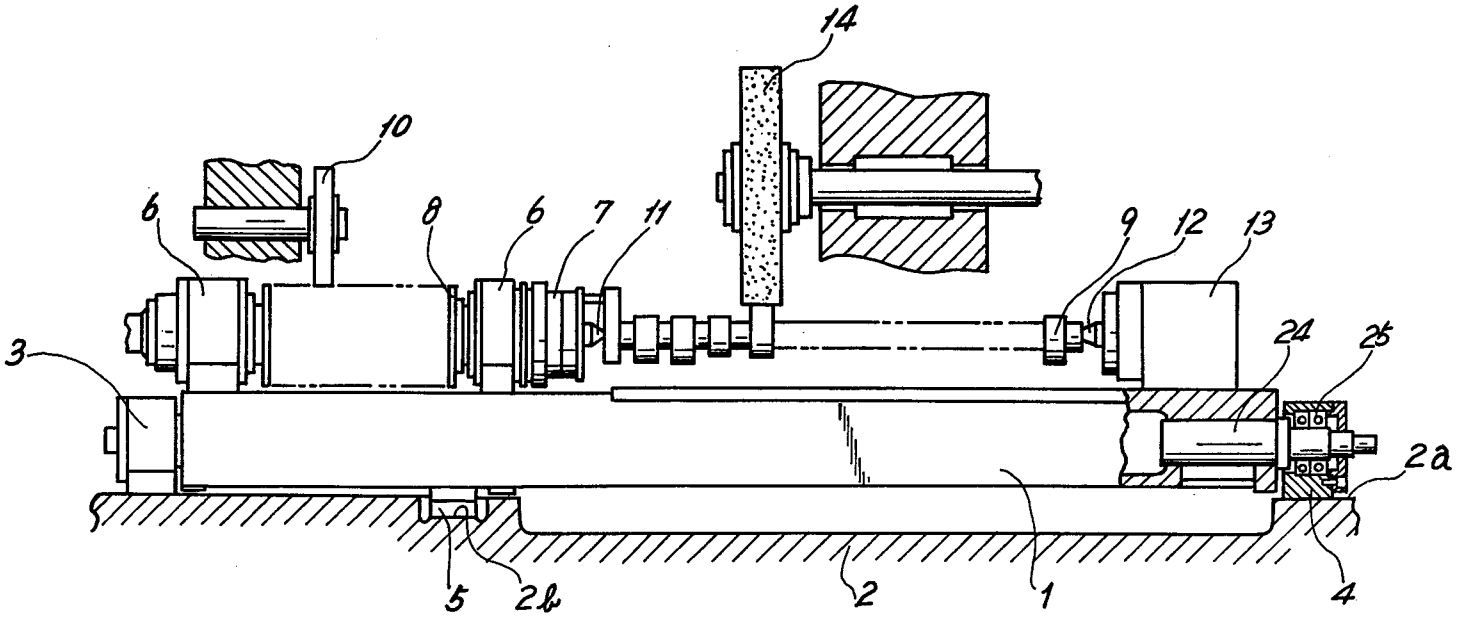
FIG. 1 is a front elevational view of the main component parts of a cam grinding machine according to the present invention.

Referring now to the drawings, wherein like reference numerals or characters refer to identical or corresponding parts throughout the several views, and more particularly to FIG. 1, there is shown a swing table 1 which is swingably mounted on a traverse table 2 through three supports 3, 4 and 5 disposed at opposite ends and at an intermediate portion thereof. A pair of main bearing housings 6 are fixedly mounted on the swing table 1 and rotatably support a spindle 7. A tubular master cam shaft 8 is keyed on the spindle 7 and is provided with a plurality of master cams having the same cam profiles as a plurality of cams of a cam shaft 9 to be ground. One of the master cams is adapted to be aligned with and held in contact with a follower roller 10 through a swing arm and a spring, not shown. The spindle 7 is provided at one end thereof with a center 11 which rotatably supports the cam shaft 9 in cooperation with another center 12 held in a foot stock 13 which is also mounted upon the swing table 1. The cam shaft 9 is rotated by a dog associated with the spindle 7 and ground by a grinding wheel 14 disposed laterally of the cam shaft 9.

Figure 2:
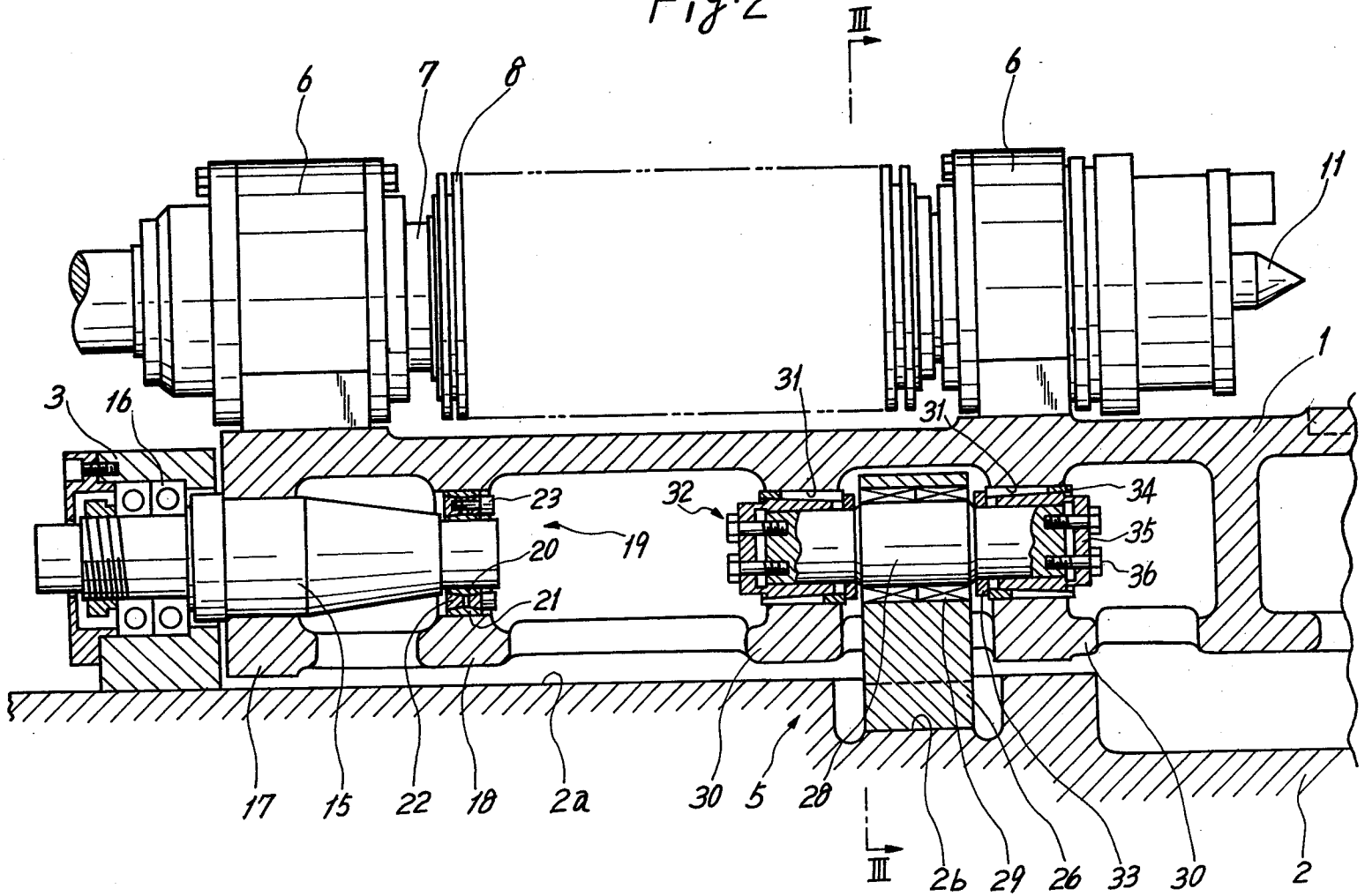
FIG. 2 is a detailed sectional view of a swing table support device shown in FIG. 1.

The end supports 3 and 4 of the swing table are fixed on a normal mounting surface **2*a* of the traverse table 2. A first support shaft 15 is rotatably supported at its one end within the support 3 through bearings 16, as shown in FIG. 2. An intermediate portion of the first support shaft 15 is press-fitted into a side wall 17 of the swing table 1. The inner end of the first support shaft 15 is supported in an inside wall 18 of the swing table 1 through a tightening device 19. The tightening device 19 comprises a tubular contractible member 20, the inner surface of which is fitted on the inner end of the first support shaft 15. The outer surface of the contractible member 20 is provided with intersected tapered portions. A tubular expansible member 21 is fitted at its outer surface into the inside wall 18 of the swing table 1. The inner surface of the expansible member 21 is also provided with intersected tapered portions. A plurality of pairs of ring members 22, each having at its outer surface a tapered portion corresponding to the tapered portions of the contractible and expansible members 20 and 21, are arranged between the contractible and expansible members 20 and 21. A clamp bolt 23 is provided to adjust the relative positions of each pair of tapered ring members 22 to fixedly support the inner end of the first support shaft 15. As shown in FIG. 1, an opposite second support shaft 24 is also press-fitted at its one portion into the side wall of the swing table 1 and rotatably supported at its other portion by the support 4 through bearings 25**.

Figure 3:
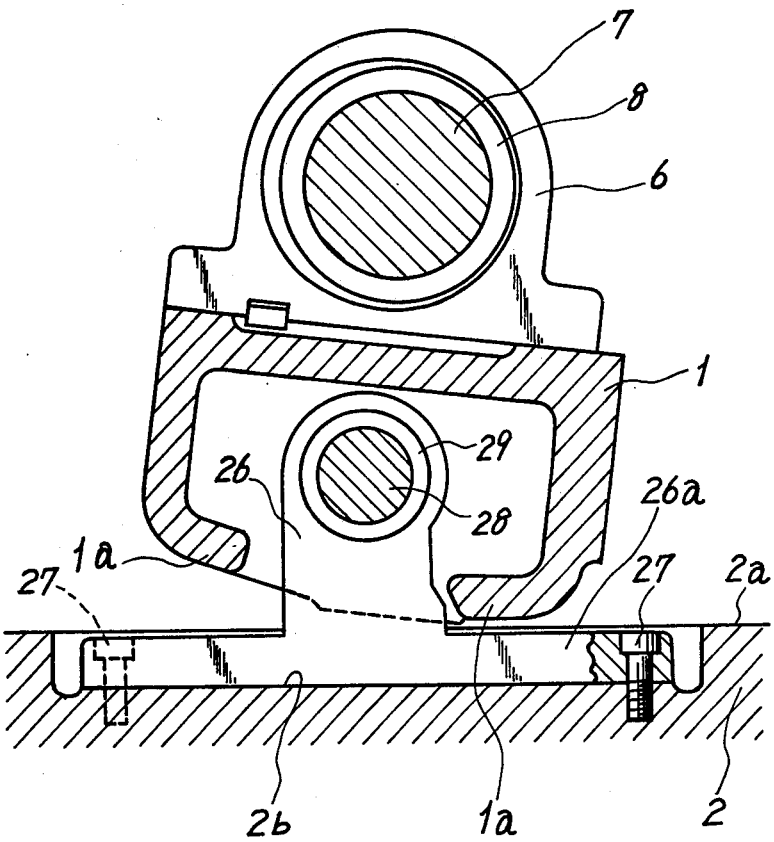
FIG. 3 is a sectional view taken along the lines III—III of FIG. 2.

As shown in FIGS. 2 and 3, a mounting surface 2b of the traverse table 2, to which a bearing support 26 for the intermediate support 5 of the swing table is fixed, is made lower than the normal surface 2a so that a flange portion 26a of the bearing support 26 does not project beyond the normal mounting surface 2a. Clamp bolts 27 for clamping the bearing support 26 on the mounting surface 2b are arranged outside the width of the swing table 1. The bearing support 26 rotatably supports a third support shaft 28 through needle bearings 29 in coaxial relation with the first and second support shafts 15 and 24. The swing table 1 is formed at its underside with a pair of inside walls 30 and 30 which have respective bores 31 and 31 formed therein and coaxial with the first and second support shafts 15 and 24. The opposite ends of the third support shaft 28 are received and fixed in the bores 31 through respective tightening devices 32.

The tightening devices 32 each comprises a collar 33 held in abutting engagement with a shoulder portion of the third support shaft 28. A collet bushing 34 is fitted at its outer surface into the respective bore 31 of the inside wall 30. One end of the collet bushing 34 is engaged with the collar 33. The inner surface of the collet bushing 34 is tapered inwardly toward the collar 33. A cotter sleeve 35 is fitted at its inner surface on the third support 28. The outer surface of the cotter sleeve 35 is tapered inwardly toward the collar 33 and engaged with the inner tapered surface of the collet bushing 34. Clamp bolts 36 are threaded through the end wall of the cotter sleeve 35 into the end face of the third support shaft 28 to adjust the position of the cotter sleeve 35 relative to the collet bushing 34 to thereby fixedly support the one end of the third support shaft 28 in the bore 31 of the inside wall 30.

As described above, according to the present invention, the first and second support shafts 15 and 24 supported by the end supports 3 and 4 through bearings 16 and 25 are swung with the swing table 1. The third support shaft 28 supported by the intermediate support 5 is also swung with the swing table 1. As a result, a cam grinding operation can be effected.

Furthermore, according to the present invention, the mounting surface 2b for the bearing support 26 of the intermediate support 5 is formed lower than the normal surface 2a of the traverse table 2 for the supports 3 and 4, whereby the lower side of the swing table 1 is prevented from interference with the flange portion 26a of the bearing support 26 at its swinging end, and therefore there is no necessity to eliminate the lower outside wall, as in the conventional manner, and it is possible to provide a thick lower outside wall 1a, as shown in FIG. 3. Accordingly, provision of the wall 1a at the lower side of the swing table 1 enhances the rigidity of the swing table 1.

The third support shaft 28 of the intermediate support 5 is rotatably supported through the needle bearing 29 on the bearing support 26 which is fixedly mounted on the traverse table 2. The opposite ends of the third support shaft 28 are centripetally secured by the tightening device 32 in the bores 31 formed on the inside walls 30 of the swing table 1. Therefore, there is no clearance between the third support shaft 28 and the bores 31, even if there is any dimensional dispersion of the bores 31. The bearing support 26 is short in length and therefore easy to machine, which can provide a high grade of fitting of the needle bearing 29 and thus enhance the rigidity of the support 5.

Therefore, according to the present invention, the rigidity of the swing table and the support device therefor is assured, even if a CBN grinding wheel for a cam grinding machine is rotated at a high speed and fed against a cam shaft at a high feed speed.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A cam grinding machine for grinding a cam shaft comprising:

a traverse table;

a swing table;

first and second end support means mounted on a first surface of said traverse table for swingably supporting said swing table at opposite ends thereof;

third intermediate support means arranged between said first and second end support means and mounted on a second surface of said traverse table, said second surface being lower than said first surface;

a shaft rotatably supported by said third intermediate support means; and tightening means for fixing the opposite ends of said shaft into bores formed on inside walls of said swing table.

2. A cam grinding machine as claimed in claim 1, wherein said third intermediate support means is provided with a flange portion which is secured on said second surface of said traverse table in such a manner as not to project beyond said first surface.

3. A cam grinding machine as claimed in claim 2, further comprising a plurality of clamp bolts arranged outside the width of said swing table for clamping said flange portion on said second surface.

4. A cam grinding machine as claimed in claim 1, wherein said tightening means comprises:

a collar held in abutting engagement with a shoulder portion of said shaft;

a collet bushing fitted at its outer surface into the bore of said inside wall and engaged at one end thereof with said collar, the inner surface of said collet bushing being tapered inwardly toward said collar;

a sleeve member fitted at its inner surface on said shaft, the outer surface of said sleeve member being tapered inwardly toward said collar and engaged with the inner tapered surface of said bushing; and clamp means threaded through an end wall of said sleeve member into an end face of said shaft.

* * * * *